United States Patent [19]

Billings

[11] Patent Number: 4,708,083

[45] Date of Patent: Nov. 24, 1987

[54] MOORING DEVICE FOR BOATS

[76] Inventor: Chris L. Billings, 527 Miller Ave., Layton, County of Davis, Utah 84041

[21] Appl. No.: 944,178

[22] Filed: Dec. 22, 1986

[51] Int. Cl.[4] ..... B63B 21/00

[52] U.S. Cl. ..... 114/230; 114/221 R

[58] Field of Search ..... 114/230, 219, 218, 221 R; 294/19.1

[56] References Cited

U.S. PATENT DOCUMENTS 3,224,404 12/1965 Jong ..... 114/230

3,863,591 2/1975 Wild ..... 114/230

*Primary Examiner*—Jeffrey V. Nase

*Assistant Examiner*—Edwin L. Swinehart

*Attorney, Agent, or Firm*—M. Ralph Shaffer

[57] ABSTRACT

A hand-manipulated device for mooring boats to docks, both of the same being provided with cleats, and the device comprising essentially an elongate spacer member having opposite end fittings each provided with an outer edge. These edges are recessed to provide a concave, cleat-receiving seat for proper positionment of the device. The device itself includes suitable apertures for receiving an elongate flexible member such as a cord that is loosely looped at the opposite ends of the device to loop over and engage the cleats. The cord is then pulled tight such that the loops tightly surround the cleat risers or posts, and the cord is itself fastened to a cleat provided the device so that the cord is maintained in top condition. The device thus not only secures the boat to a dock, by the cleats of the same, but also, by virtue of the nature of the elongate spacer member, the boat is held in a spaced condition relative to the dock so that the boat sides will not be marred through jarring against the dock or its supporting pillars. The elongate spacer member is preferably of telescoping nature so that the length thereof can be adjusted.

3 Claims, 7 Drawing Figures

MOORING DEVICE FOR BOATS

FIELD OF INVENTION

The present invention relates to devices for mooring boats to docks, and, more particularly, to a new and improved device which both moors and spaces the boat relative to the dock in a safe and convenient manner.

DESCRIPTION OF PRIOR ART

In the past ropes have been secured either to a boat or to a dock, or both, for the purpose of mooring or tying up the boat relative to the dock or dock platform. Boats and docks are frequently supplied with raised cleats accommodating a rope tie-up. There is ever present the problem of a boat passenger reaching out to loop the boat rope around a dock cleat without the passenger losing his footing and perhaps even falling in the water. In some instances, especially where weather is inclement and/or there are appreciable waves around the dock area, the boat tie-up operation can be one fraught with some danger if not at least some mishap.

There is likewise the problem of having some type of styrofoam or other padding, secured either to the boat or to the dock, so as to preclude damage to boat sides during the rise and fall of the water relative to the boat platform. It would much simplify matters if there were a suitable hand-manipulated device for conveniently securing the boat to a dock at the latter's cleats and, simultaneously, tying up the boat relative to the dock such that the boat is spaced from the dock in a manner so that the sides of the boat will not be marred during boat-dock collisions that might otherwise occur.

BRIEF DESCRIPTION OF INVENTION

According to the invention in a preferred embodiment thereof an elongate spacer member, used to space the boat relative to the dock, is provided, the same having forward-end and rear-end fittings. These fittings are designed to have outer edges provided with concave seats, these latter seats serving as cradles or nestling portions that receive the post or lower portions of respective cleats as may be mounted to the boat and to the dockside. The elongate spacer member is preferably of telescoping configurement, having a hollow principal member receiving an extension member, the hollow principal member itself being provided with a cleat that can selectively friction engage the extension member to predetermine the length thereof in a fixed setting. The end fittings themselves may be simply configured integral plates, or may be fittings that are simply snapped, threaded, or glued over the opposite ends of the elongate spacer member. Whatever their form, the end fittings of the device are each provided with a pair of apertures for receiving a flexible elongate member such as a cord. The cord has a knotted end, and is configured and arranged so as to provide for extended loop portions proximate the forward and rearend fittings of the device. These loop portions are designed to fit easily over the cleats of the dock and the boat. Once the user places the looped forward end of the cord over the dockside cleat, then he can immediately implace the rear looped portion of the cord over the boat cleat and draw the cord tight, securing the same to the cleat portion of the elongate spacer member. The cord loops in being drawn tightly about the cleats of the dock and boat, will secure the cleat posts within the concave extremities of the end fittings of the device. The elongate spacer member thus spacedly retains the boat relative to the dock so that the boat will not jar against the dockside. The use of plural cleats for the boat are advised so that plural members can be employed to tie up the boat in spaced relation relative to the dock. In a preferred form of the invention the inner extension member of the device is supplied with a slot for accommodating a slot that is close ended, for delimiting extension of the extension member relative to the hollow principal member so that the two members do not become disassociated. The cleat can be threaded into the wall of the hollow principal member so that, by suitable rotative adjustment, the cleat handle can engage and then subsequently release the extension member for additional adjustment as may be desired.

OBJECTS

Accordingly, a principal object of the present invention is to a provide a new and improved device for mooring boats to docks.

A further object is to provide a mooring device that is conveniently constructed for hand-manipulation, and which moors boats to docks at the respective cleats of the same.

A further object is to provide an elongate adjustable device that is hand-manipulated and provided a cord or other flexible elongate member, for securing a boat to dockside.

An additional object is to provide a mooring member having opposite ends which are configured to receive, at least partially, the posts of mounted cleats, which device is also provided a cord for looping about the cleats to draw the cleats tightly into the concave areas of the ends of the device.

A further object is to provide a cleat in a hand-manipulated mooring device, wherein the cleat not only is constructed to receive cord turns but also is rotatable and serves as detent or friction element relative to the telescoping construction of such device.

BRIEF DESCRIPTION OF DRAWINGS

The present invention may best be understood by reference to the following description, taken in connection with the accompanying drawings in which.

DETAILED DESCRIPTION OF PREFERRED EMBODIMENTS

Figure 1:
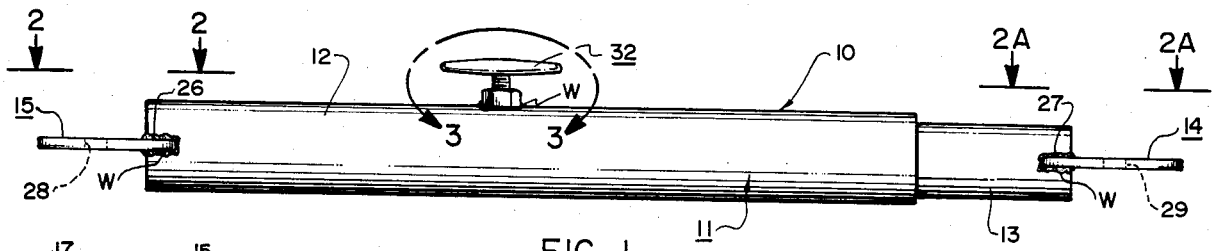
FIG. 1 is a side elevation of a mooring device constructed in accordance with the principles of the present invention.
Figure 2:
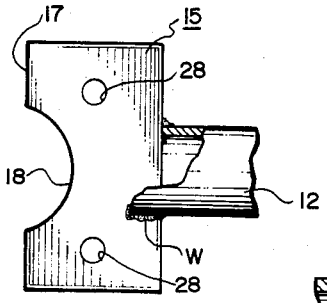
FIG. 2 is a detail taken along the line 2—2 in FIG. 1.

In FIG. 1 the device 10 includes an elongate spacer member 11 which, in one form of the invention, includes a hollow outer principal member 12 and an extension member 13. The extension member 13 is telescopingly received by the hollow principal member 12. It is conceivable, of course, that, for fixed length constructions, the elongate space member 11 may take the form shown in FIG. 5 at 11A, wherein but a single unitary elongate member is involved.

Figure 6:
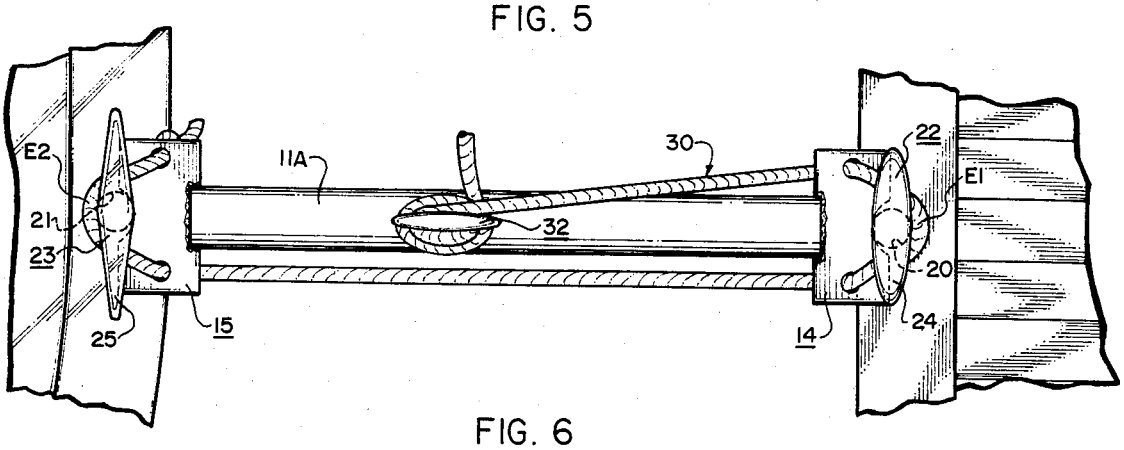
FIG. 6 is similar to FIG. 5 but illustrates the condition wherein the elongate flexible member or cord has been tightened and secured to the cleat to the device such that the looped ends of the cord are now tight, thereby firmly securing the posts of the cleats into the concave areas of the device's ends.

In any event, disposed at opposite extremities of the composite elongate spacer member 11 in FIG. 1 are forward end fitting 14 and rear-end fitting 15. These have outer edges 16 and 17 which are provided with concave recessed areas forming cleat post receiving cavities at 18 and 19. These will cradle or receive the posts 20 and 21 of cleats 22 and 23 in FIG. 6. The cleats may have mounting bases or simply lower post ends that are secured by nut or other means to the boat rail and the dock. The horn or upper bar 24 and 25 of each of the cleats is made integral with the respective cleat post.

Figure 3:
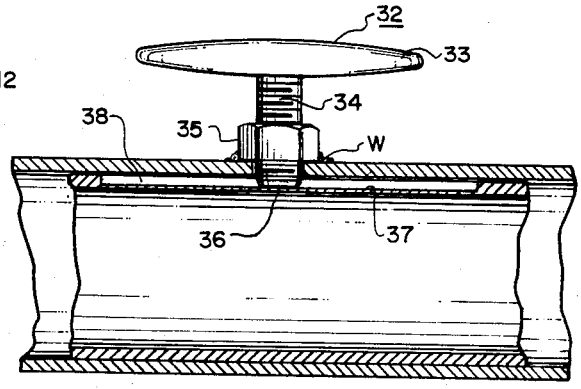
FIG. 3 is an enlarged fragmentary detail, principally in section, of the elongate spacer member of the device wherein the same takes a telescopic construction, the cleat of the device being threaded and rotatable for purposes not only for securement but also of delimiting and fixing the extension of the elongate spacer member of the device.
Figure 2A:
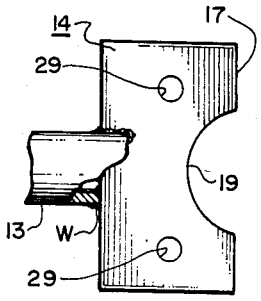
FIG. 2A is similar to FIG. 2 but illustrates the right hand extremity of the device in FIG. 1, being taken along the line 2A—2A therein.
Figure 5:
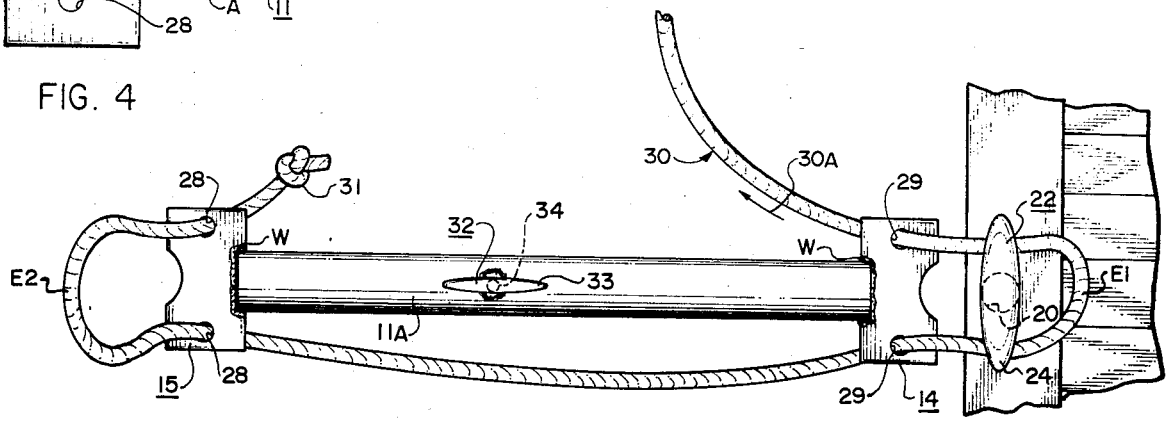
FIG. 5 is a top plan of the device of FIG. 1 wherein the same is initially implaced by a boat passenger over the cleat of a dock and, subsequently, where the rearward end of the device is thrust downwardly such that the looped end of the cord at such location will be placed over the cleat of the boat side, the end of the cord being available for pulling.

In FIG. 1 the members forming the composite elongate spacer member 11 are provided with slots 26 and 27 that receive the forward end fitting 14 and the rearward end fitting 15. Welding, brazing, or soldering may be effected at W to secure the plates or end fittings to and within such slots. The end fittings will be supplied a pair of apertures 28 and 29 for receiving flexible elongate member or cord 30. Cord 30 has a knotted end at 31 serving to preclude the cord from becoming separated from the rearward end fitting 15. The cord is looped through the several apertures, and is provided outermost looped ends at E1 and E2 as indicated in FIG. 5. The elongate spacer member 11A in FIG. 5, corresponding to eleongate spacer member 11 in FIG. 1, includes a cleat 32 comprising a horizontal bar portion 33 and post 34. If desired, see FIG. 3, the post 34 may be threaded at 35, such threaded end threading into the threaded base or nut 36 that is affixed to the hollow principal member 12 medially at its outermost side. Accordingly, cleat 32 serves not only to receive the wrapped end of the cord but also is constructed for preliminarily tightening down within the nut 35 so that the end 36 tightly engages grooved base 37 of groove or slot 38. The slot 38 is closed ended so that the two telescoping members of FIG. 1 will not become disengaged. The tightening down of the cleat will press its end against the slot base so as to fix, at least temporarily, the extension of extension member 13 relative to hollow principal member 12.

Figure 4:
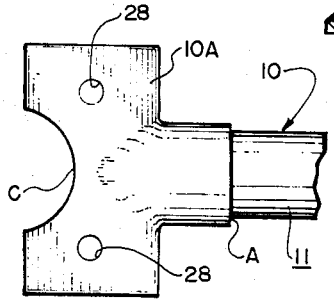
FIG. 4 is a top plan taken along the line 2—2 in FIG. 1 of an alternate device wherein the end fittings, both forward and rearward, take the form of moldings or castings that are simply slipped over the opposite ends of the elongate spacer and are threaded, welded, or simply glued in place.

FIG. 4 illustrates one typical end of the two ends of a modified device 10A, wherein the end fittings are simply cast or molded and are slipped over the opposite ends of elongate principal member 11. Securement may be by threads, glue, or other securement means at A. In any event, the end fittings, both front and rear, will be provided with a concave portion C, for receiving the cleat post of the dock and boat cleats 22, 23, resepectively.

In operation, and as FIG. 5 demonstrates, the passenger or operator of the boat will simply place the loosely looped end E1 over a dock cleat. Once this operation is performed, the loose end E2 of the cord will be placed over the boat cleat. Then the device is placed in tightened securement by the user simply by drawing up on cord 30 in the direction of Arrow 30A in FIG. 5 and wrapping the cord end about cleat 32 in the manner shown in FIG. 6 such that the looped ends are drawn tight and the cleat posts become oriented in the cavities or recesses of the end fittings of the device. For different boats, it is conceivable that different spacings between boat and dock will be appropriate in which event there will be a pre-adjustment of the elongate spacer member 11, this by loosening the cleat 32 and allowing the extension member to slide outwardly or inwardly within hollow principal member 12. Of course, and as before explained, it is very conceivable that for most boats a fixed length of elongate spacer member 11 will be needed, in which event spacer member 11A of FIG. 5 will be provided.

It is seen that, because of the looped configurement at E1 of the cord, the same can be easily placed by a user over a dock cleat while the boat is being taxied up to mooring position. Once this is done, then it becomes an easy matter for the rear loop E2 to be placed over the side rail cleat of the boat and the cord drawn up to fasten the boat in spaced relationship relative to the dock. Such a hand-manipulated device as is herein disclosed easily prevents foot slippage or falling by the passenger or boat operator, thereby enhancing safety while at the same time mooring the boat satisfactorily in spaced relationship relative to the dock so as to eliminate the necessity of protective dock or boat pads and the like.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. A hand-manipulated device for mooring boats, including, in combination: an elongate spacer member having opposite end fittings each provided with an outer edge, each of said edges being provided with a concave, cleat-post receiving seat, said fittings lying essentially in the same plane, and said fittings each being provided with a pair of cord-receiving apertures; a cord disposed through all of said apertures and knotted at one end thereof, said cord being constructed to form, selectively, loops respectively proximate said edges for routing over external dock and boat cleats, respectively, and said elongate spacer member being provided with a cleat for receiving the wrapped, tightened securement thereto of said cord when said cord is tightened about said cleats at said loops, said cleats thereby being adapted to be retained against said seats of said opposite end fittings by said cord when so tightened.

2. A hand-manipulated device for mooring boats, including, in combination: an elongate spacer member having opposite end fittings each provided with an outer edge, each of said edges being provided with a concave, cleat-post receiving seat, said fittings lying essentially in the same plane, and said fittings each being provided with a pair of cord-receiving apertures, and said elongate spacer member comprising a length-adjustable, telescoping device having an inner extension member providing one of said end fittings and a hollow principal member providing the remaining one of said end fittings and inwardly receiving said inner extension member, said elongate spacer member being provided with a cleat, said spacer member cleat being mounted to said principal member and selectively engaging said extension member for fixing the disposition thereof relative to said principal member; a cord disposed through all of said apertures and knotted at one end thereof, said cord being constructed to form, selectively, loops respectively proximate said edges for routing over external dock and boat cleats, respectively, and said elongate spacer member being provided with said cleat for receiving the wrapped, tightened securement thereto of said cord when said cord is tightened about said boat and dock cleats at said loops, said cleats thereby being adapted to be retained against said seats of said opposite end fittings by said cord when so tightened.

3. A hand-manipulated device for mooring boats, including, in combination: an elongate spacer member having opposite end fittings each provided with an outer edge, each of said edges being provided with a concave, cleat-post, receiving seat, said fittings lying essentially in the same plane, and said fittings each being provided with a pair of cord-receiving apertures, and said elongate spacer member comprising a length-adjustable, telescoping device having an inner extension member providing one of said end fittings and a hollow principal member providing the remaining one of said end fittings and inwardly receiving said inner extension member, said elongate spacer member being provided with a cleat, said spacer member cleat being mounted to said principal member and selectively engaging said extension member for fixing the disposition thereof relative to said principal member, said inner extension member having an outer longitudinal slot, said principal member cleat being threaded into said principal member, protruding therewithin, and riding in said slot; a cord disposed through all of said apertures and knotted at one end thereof, said cord being construced to form, selectively, loops respectively proximate said edges for routing over external dock and boat cleats, respectively, and said elongate spacer member being provided with said cleat for receiving the wrapped, tightened securement thereto of said cord when said cord is tightened about said boat and dock cleats at said loops, said cleats thereby being adapted to be retained against said seats of said opposite end fittings by said cord when so tightened.

* * * * *